US007342504B2

(12) United States Patent
Crane et al.

(10) Patent No.: US 7,342,504 B2
(45) Date of Patent: Mar. 11, 2008

(54) MONITORING SYSTEM AND METHOD

(75) Inventors: Patrick R. Crane, Marina del Rey, CA (US); Alan K. Pittman, Oak Park, CA (US)

(73) Assignees: Aeromesh Corporation, Century City, CA (US); Timothy Crane, Calabasas, CA (US)

( * ) Notice: Subject to any disclaimer, the term of this patent is extended or adjusted under 35 U.S.C. 154(b) by 242 days.

(21) Appl. No.: 11/303,435

(22) Filed: Dec. 16, 2005

(65) Prior Publication Data

US 2006/0181425 A1 Aug. 17, 2006

Related U.S. Application Data

(63) Continuation of application No. 10/091,852, filed on Mar. 5, 2002, now Pat. No. 7,002,481.

(51) Int. Cl.
*G08B 21/00* (2006.01)

(52) U.S. Cl. ..... 340/612; 340/540; 340/606; 340/621; 340/539.16; 364/509; 364/510

(58) Field of Classification Search ..... None
See application file for complete search history.

(56) References Cited

U.S. PATENT DOCUMENTS 4,070,563 A * 1/1978 Petroff ..... 702/47
4,119,382 A 10/1978 George et al. ..... 356/249
4,295,197 A * 10/1981 Petroff ..... 702/45
4,386,409 A * 5/1983 Petroff ..... 702/48
4,799,388 A 1/1989 Hunter ..... 73/861.63
4,896,542 A 1/1990 Hunter ..... 73/861.63
5,111,201 A 5/1992 Matsumura et al. ... 340/870.38
5,199,306 A 4/1993 Hunter ..... 73/861.63
5,330,061 A 7/1994 Geitz ..... 211/105.4
5,406,828 A 4/1995 Hunter et al. ..... 73/4
5,423,226 A 6/1995 Hunter et al. ..... 73/861.63
5,565,783 A 10/1996 Lau et al. ..... 324/522
5,608,171 A * 3/1997 Hunter et al. ..... 73/861.63

(Continued)

OTHER PUBLICATIONS

Marsh-McBirney, Inc. home web page printout from www.marsh-mcbirney.com (undated).

(Continued)

*Primary Examiner*—Benjamin C. Lee
*Assistant Examiner*—Son Tang
(74) *Attorney, Agent, or Firm*—Irell & Manella LLP

(57) ABSTRACT

A monitoring system includes one or more monitoring devices, positioned in sewer manholes, storm drains, etc., and a remote monitoring station that communicates wirelessly therewith. The monitoring device may be an integrated unit, including sensors, a two-way telemetry unit, a power supply, a processor, and supporting hardware, all located in an enclosed, waterproof housing. The monitoring device is placed within a manhole cavity to obtain depth (e.g., water level) measurements and report the measurements back to the remote monitoring station, which analyzes the data and responds to alert messages when a dangerous water level is detected. The sample and reporting rates of the device, as well as the water level threshold values, may be remotely programmable via commands transmitted from the remote monitoring station. An additional sensor may monitor the manhole cover for security purposes. Additional external monitoring instruments may be connected to the device, which relays data therefrom to the remote monitoring station.

36 Claims, 7 Drawing Sheets

U.S. PATENT DOCUMENTS

| | | | | |
|---|---|---|---|---|
| RE35,503 | E | 5/1997 | Hunter | 73/861.63 |
| 5,684,250 | A | 11/1997 | Marsh et al. | 73/227 |
| 5,811,688 | A | 9/1998 | Marsh et al. | 73/861.25 |
| RE36,069 | E | 2/1999 | Hunter | 73/215 |
| 5,942,698 | A * | 8/1999 | Stevens | 73/863.03 |
| 6,539,794 | B1 | 4/2003 | Otto et al. | 73/290 V |
| 2002/0041238 | A1 | 4/2002 | Johnson et al. | 340/870.28 |

OTHER PUBLICATIONS

"Open Channel Flowmeters," printout from www.marsh-mcbirney.com/open%20channel.html (undated).

Product Family Overview, Stevens Water Monitoring System, website printout from www.stevenswater.com (Nov. 9, 2001).

Johnson, Dick, "Differential Flowmeters: Simple Can Be Better," Control Engineering Online, website printout from www.controleng.com (Sep. 2000), pp. 1-3.

"Liquid Flowmeters," Omega.com Technical Reference, website printout from www.omega.com/techref/flowcontrol.html, reprinted from Plant Engineering Magazine, Nov. 21, 1984, by Cahners Publishing Company.

Bezerko, Richard, "Choosing an ultrasonic liquid-level sensor," SensComp, Livonia, MI, printout from www.electronicproducts.com (undated).

"The Telogers Enterprise System," webpage link for Telog Instruments, Inc., http://www.telog.com/flash/Enterprise_System_applications.htm, dated 2006.

Internet archive summary page for telog.com, http:/web.archive.org/web/*/http://www.telog.com, printed Jan. 24, 2007.

"Welcome to Telog Instruments, Inc. Provider of Remote Data Acquisition Solutions," Oct. 27, 2000, http://web.archive.org/web/20001027104728/http://www.telog.com.

"Telog Products," Oct. 27, 2000, http://web.archive.org/web/20000919231955/www.telog.com/products.shtml.

"Telog R-3314 Teloger 14-channel Recorder for Remote Data Acquisition," Rev. 0898, Oct. 27, 2000.

"Telog R-3308 Teloger Eight-channel Recorder for Remote Data Acquisition," Oct. 27, 2000.

"Colorado Water Utility Saves Personnel, Maintenance Costs with Digital pressure Recorder," Oct. 27, 2000, reprinted from Water & Wastes Digest Magazine, Apr. 2000.

"Telog Data Acqusition Remote Wireless," http://web.archive.org/web/20011202155956/http://www.telog.com/, Dec. 2, 2001.

"Telog Gas Products," http://web.archive.org/web/20011031122217/www.telog.com/gas.htm, Dec. 2, 2001.

"HPR-21 Hydrant Pressure Recorder," http://web.archive.org/web/20011218224035/www.telog.com/Applications/hpr_21.htm, Dec. 2, 2001.

"HPR-21 Specification," http://web.archive.org/web/20020102173628/www.telog.com/hpr_21_specs.htm, Dec. 2, 2001.

"Telog's RS-33 Recording System For Remote Monitoring of Distribution System," Dec. 2, 2001.

"RS-33 Remote Monitoring System," http://web.archive.org/web20070124200102/http://www.telog.com/remote_monitoring.htm, Dec. 2, 2001.

"WLS-2109e Water Level Recorder," http://web.archive.org/web/20011031113133/www.telog.com/applications/wls_21.htm, Dec. 2, 2001.

"WLS-2109e Technical Specifications," http://web.archive.org/web/20020102190214/www.telog.com/wls_21_specs.htm, Dec. 2, 2001.

"CSO/SSO Monitoring," http://web.archive.org/web/20011126192020/www.telog.com/applications/wwd_3.htm, Dec. 2, 2001.

"Flow Monitors and Communications, Flow Monitoring Systems," webpage link for ADS Corporation, specifically http://www.adsenv.com/defalut.aspx?id=21, printed on Sep. 12, 2007.

Internet archive summary page for adsev.com, http:/web.archive.org/web/*/http://www.adsenv.com, printed Jan. 24, 2007.

"Welcome to ADS's Homepage!" http://web.archive.org/web/20001219092900/http://www.adsenv.com/index.html, Dec. 19, 2000.

"What We Do, The products, services, and capabilities we offer," http://web.archive.org/web/20001219183100/www.adsenv.com/what_we_do.html, Dec. 19, 2000.

"What We Do: Products," landscape version, http://web.archive.org/web/20010106110500/www.adsenv.com/what_we_do-products.html, Dec. 19, 2000.

"What We Do Products," portrait version, http://web.archive.org/web/20010106110500/www.adsenv.com/what_we_do-products.html, Dec. 19, 2000.

"Model 4000," http://web.archive.org/web/200101240757/www.adsenv.com/what_we_do-products_4000.html, Dec. 19, 2000.

"Profile™ Software, Profile the Performance of Your Collection System," http://web.archive.org/web/20010420171548/www/adsenv.com/what_we_do-products-prof.html, Dec. 19, 2000.

"Model 3500," http://web.archive.org/web/20010106114800/www.adsenv.com/what_we_do-products_3500.html, Dec. 19, 2000.

"Model 3600," http://web.archive.org/web/20010106120600/www.adsenv.com/what_we_do-products_3600.html, Dec. 19, 2000.

"Model 5600," http://web.archive.org/web/20010106121800/www.adsenv.com/what_we_do-products_5600.html, Dec. 19, 2000.

"Model 1500," http://web.archive.org/web/20010302080448/www.adsenv.com/what_we_do-products_1500.html, Dec. 19, 2000.

"Model 1600," http://web.archive.org/web/20010303013913/www.adsenv.com/what_we_do-products_1600.html, Dec. 19, 2000.

"Rain Alert 3600," http://web.archive.org/web/20010106100700/www.adsenv.com/what_we_do-p-rainalrt_3600.html, Dec. 19, 2000.

"Master Series™ , Infrastructure Management Software," http://web.archive.org/web/20010106103300/www.adsenv.com/what_we_do-products-mast.html, Dec. 19, 2000.

"Welcome to ORE Offshore," http://web.archive.org/web/20010301205753/www.ore.com, Dec. 19, 2000.

"SCADA Systems," http://web.archive.org/web/20010106101800/www.adsenv.com/what_we_do-products-SCADA.html, Dec. 19, 2000.

"What We Do: Services," http://web.archive.org/web/20001212212300/www.adsenv.com/what_we_do-services.html, Dec. 19, 2000.

"Flow Monitoring," http://web.archive.org/web/20001008100634/www.adsenv.com/what_we_do-services-flomon.html, Dec. 19, 2000.

"Welcome to ADS Corporation's Homepage," http://web.archive.org/web/20020122183413/http://www.adsenv.com, Jan. 22, 2002.

"ADS What We Do, The products, services, and capabilities we offer," http://web.archive.org/web/20020214224239/www.adsenv.com/what_we_do.htm, Jan. 22, 2002.

"ADS What We Do: Products," http://web.archive.org/web/20011122165419/www.adsenv.com/what_we_do-products.htm, Jan. 22, 2002.

"ADS Introduces IntelliScan?" http://web.archive.org/web/20020113194034/www.adsenv.com/what_we-doproducts_IntelliScanrel.htm, Jan. 22, 2002.

"ADS Model 4000 Open Channel," http://web.archive.org/web/20020917010215/adsenv.com/what_we_do-products_4000.htm, Jan. 22, 2002.

"ADS Model 3600," http://web..archive.org/web/20020917011001/adsenv.com/what_we_do-products_3600.htm, Jan. 22, 2002.

"ADS What We Do: Services," http://web.archive.org/web/20011226224643/www.adsenv.com/what_we_do-services.htm, Jan. 22, 2002.

"ADS Flow Monitoring," http://web.archive.org/web/20020618032830/www.adsenv.com/what_we_do-services.flomon.htm, Jan. 22, 2002.

"MOSCAD Wireless Monitoring and Control Solutions for the Water/Wastewater Industry," MotoMonitor, Motorola, Inc., 2005.
"System Integration and Design Inc., BOTAS Natural Gas Project," printed from http://www.sys-inc.com/projects/pri_bng.htm, 2001 SYS System Integration and Design Inc., Oct. 5, 2001.
"Water & Wastes Digest (WWD), Data Logger/SCADA Integration Saves Time for Field Crews, Permits Early Warning of Problems," *Water & Wastes Digest*, Feb. 2002, vol. 42, No. 2.
"Water & Wastes Digest (WWD), Making the Right Choices for Your Wireless SCADA System," *Water & Wastes Digest*, Feb. 2000.
"Ultrsonic Technology Simplifies Flow and Level Management," *Water Engineering & Management*, Dec. 1994.
"Utility Systems Science and Software, About Us," http://www.uscubed.com/usss/about.htm, printed on Sep. 12, 2007.

* cited by examiner

MONITORING SYSTEM AND METHOD

RELATED APPLICATION INFORMATION

This application is a continuation of U.S. application Ser. No. 10/091,852, filed on Mar. 5, 2002, now U.S. Pat. No. 7,002,481. The foregoing application is hereby incorporated by reference as if set forth fully herein.

BACKGROUND OF THE INVENTION

1) Field of the Invention

The field of the present invention relates generally to monitoring devices and methods and, more particularly, to devices and methods for monitoring water depth and other aspects of sewers, storm drains, waterways, and the like.

2) Background

Most municipalities have a sanitary wastewater system, the purpose of which is to collect and transport waste matter from the various drains, disposals and other sources within the community to a sewage treatment plant or other such facility. Ideally, the waste matter is transported via the sanitary wastewater system without any spillage or leakage whatsoever. However, sanitary wastewater systems can be enormous in scale, making their management and maintenance extremely challenging tasks. Even in smaller municipalities, managing and maintaining the local sanitary wastewater system can be difficult. Problems often arise from the demands placed upon these systems, which may be found in widely varying states of repair. Such demands generally include severe weather conditions (such as heavy rains or freezing temperatures), accumulation of obstructive materials (e.g., grease, sediment, roots or other debris), and groundwater infiltration, to name a few. In addition, community growth, either industrial or residential, can lead to increased strain on an existing sanitary wastewater system. When the wastewater collection system becomes taxed beyond capacity, manhole overflows and/or backflow into residential areas may result.

The adverse conditions preceding an overflow (or other similar event) often exist over an extended period of time (usually several days or weeks), gradually worsen, and, if not detected and rectified, cause the inevitable result. During the time preceding such an overflow event, wastewater begins to accumulate in one or more localized areas within the collection system, until gradually the level of the wastewater becomes so high it breaches the nearest outlet—usually a manhole opening—or else backs upstream where further problems can be caused.

A sewer overflow can pose significant health hazards within a local community. The cleanup operation can be costly, and an overflow can bring about an interruption in sewer service. Also, a sewer overflow can harm the local environment, and result in potential state and/or federal penalties.

To reduce the likelihood of overflow and backflow events, it has been common practice to place flowmeters at various points within the wastewater collection system, thereby allowing the liquid flow within the system to be monitored. Often the flowmeters are placed at locations where access is convenient, such as in sewer manholes.

A variety of different flowmeters have been developed, a number of which have been used or proposed for use in a wastewater monitoring system. One common class of flowmeters has a "primary" element and a "secondary" element. The primary element is a restriction in a flow line that induces a differential pressure and/or level, and the secondary element measures the differential pressure and/or level, converts the measurements into a flow rate, and records the flow rate data. Weirs and flumes are some of the oldest and most common devices used as flowmeter primary elements. More recently, flowmeters have been developed which use ultrasonic pulses to measure the liquid level, which is then converted into a flow rate.

A variety of drawbacks exist with conventional flowmeter monitoring systems. First, many flowmeter installations are configured to provide manual reading of the flow data that has been acquired over time. Reading the flow meter data can be a burdensome task. Generally, a field worker is required to travel to the physical location of the manhole, pry off the manhole cover, descend into the manhole, and attempt to collect the data from the secondary element of the installed flowmeter. Where numerous flowmeters are installed throughout a large municipal wastewater collection system, the task of collecting flow data from all of the flow meters can be a time-consuming, labor intensive (and therefore expensive) process. In situations of sudden rainfall events or other circumstances, it can be very difficult for field workers to monitor all of the flowmeters in the system, and a risk of overflow increases.

In addition to the difficulty in obtaining flow data from flowmeters installed in a wastewater collection system, flowmeters can also be expensive, and often require a high level of accuracy that can be difficult to maintain over time. Inaccurate liquid flow measurements in the context of a wastewater collection system can lead to serious or even disastrous results. Flowmeters may also require periodic inspection and cleaning, and can therefore be relatively expensive to maintain.

Various types of sewer monitoring systems have been developed or proposed to alleviate the need for manual data collection. One example is illustrated in U.S. Pat. No. 5,608,171 to Hunter et al. However, available sewer monitoring systems of the wireless variety generally require devices that are expensive or require expensive components, can be difficult to install or remove, and/or have limited functionality or compatibility with other equipment.

It would therefore be advantageous to provide an improved technique for monitoring sewers, storm drains, waterways, and other such areas, to prevent overflows, facilitate maintenance, and improve information available for municipal planning purposes.

SUMMARY OF THE INVENTION

The invention in one aspect is generally directed to systems and methods for monitoring water depth and other conditions of sewers, storm drains, waterways, and other such areas.

In one aspect, a monitoring device is placed within a manhole or other suitable location for monitoring the buildup of water, sediment or other materials. The monitoring device preferably has a moisture-proof housing made of a non-corrosive, water-resistant material, and includes internal electrical circuitry (microprocessor, memory, etc.) for controlling the functions of the device. A sensor is oriented downward to obtain depth measurements at periodic intervals, and the measurements are stored in the device until readout at a later time. At certain intervals, the stored measurements are transmitted wirelessly to a remote monitoring station for evaluation and analysis.

In a preferred embodiment, the sample rate of the depth sensor and the frequency of reporting to the remote monitoring station are adjustable through commands downloaded wirelessly from the remote monitoring station. The monitoring device may also have internal alert modes which are entered when the monitored water level passes specific threshold values. Entry into a higher alert state may result in an increase in sampling and/or reporting rates.

In one embodiment, the monitoring device has a housing with multiple legs extending outwardly, for allowing the device to be mounted to the interior walls of a manhole. The legs can be made of a flexible, bendable, or compressible material, or else can be adjusted in size by way of a rotatable screw member or a telescoping member. In another embodiment, the monitoring device has a cylindrical housing with a slightly wider cap or head, adapted for, e.g., drop-down insertion into a hole in a manhole cover.

In various embodiments, additional external monitoring instruments may be deployed in the manhole or other location where the monitoring device is situated, and connected to ports in the monitoring device, which transmits data received from the external monitoring instruments to the remote monitoring station. Also, the monitoring device may include a second sensor, oriented upwards instead of downwards, to monitor disturbances to the manhole cover for security purposes.

A monitoring device as described herein may be used in the context of a preferred monitoring system, wherein a plurality of the monitoring devices are positioned within different manholes or other locations over a geographic region, for monitoring water level or other conditions within the various manholes or other locations. In such a system, the remote monitoring station communicates wirelessly with the monitoring devices and receives depth measurements at periodic intervals for processing and analysis. The sampling frequency and reporting frequency of the monitoring devices are preferably programmably adjustable, individually for each of the monitoring devices, through wireless commands transmitted from the remote monitoring station to the various monitoring devices.

Further embodiments, variations and enhancements are also disclosed herein.

BRIEF DESCRIPTION OF THE DRAWINGS

FIG. 6A shows an oblique view of the monitoring device with an antenna piece inserted in a manhole cover, while FIG. 6B shows a cross-sectional view thereof.

DETAILED DESCRIPTION OF PREFERRED EMBODIMENTS

Figure 1:
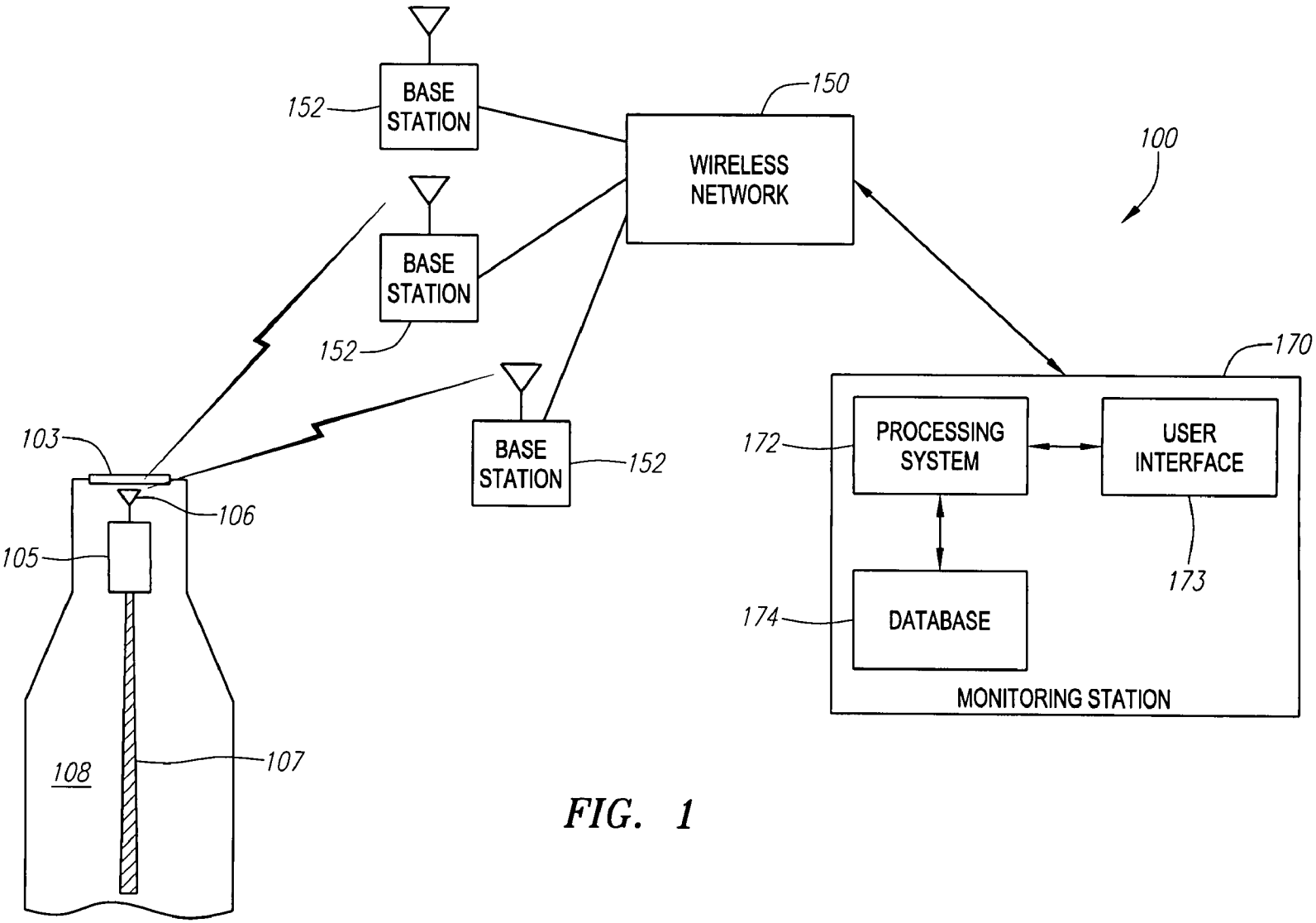
FIG. 1 is a block diagram of a monitoring system according to a preferred embodiment as disclosed herein.

FIG. 1 is a block diagram of a monitoring system 100 according to a preferred embodiment as disclosed herein. As illustrated in FIG. 1, the monitoring system 100 comprises a monitoring device 105 that can be positioned in a location for monitoring a depth (e.g., water level), such as in a manhole 108, or else in a storm drain or another suitable location. In a preferred embodiment, the monitoring device 105 manages one or more data sensors and provides timing, control, data and programming storage, and wireless communication functions to allow remote monitoring of the activity and operation of the monitoring device 105.

As further illustrated in FIG. 1, the monitoring device 105 preferably includes an antenna 106 for communicating wirelessly with remote stations. In the example shown in FIG. 1, the monitoring device 105 communicates with a remote monitoring station 170 through a wireless network 150, which can be a cellular network or any other type of wireless network. The wireless network 150 typically includes or is connected to a plurality of base stations 152 for communicating with various fixed or mobile wireless devices, such as the monitoring device 105.

While only one monitoring device 105 is shown in FIG. 1, it is to be understood that the monitoring system 100 can, and is likely to, include a significant number of monitoring devices identical or similar monitoring device 105, in order to monitor various manholes, sewer pipes, and/or other water or runoff conduits in a local vicinity or municipality. Likewise, while only a single remote monitoring station 170 is illustrated, additional remote monitoring stations may be included in the monitoring system 100, depending upon the size and scope of the overall system 100. Thus, while the principles of operation may be explained with respect to a single monitoring device 105 and remote monitoring station 170, they may be extrapolated to any number of monitoring devices and remote monitoring stations in a given system. In addition, one or more of the monitoring devices may utilize a wired connection with the remote monitoring station 170 rather than a wireless connection, particularly where the monitoring system 100 is deployed in an area having some manholes or other locations outfitted with pre-existing wirelines.

In the example of FIG. 1, the remote monitoring station 170 includes a processing system 172 which may comprise, for example, one or more computers or processors for receiving data from the monitoring device (or devices) 105, processing the data, and transmitting commands or other information back to the monitoring device (or devices) 1-5. The remote monitoring station 170 may include a database 174, local or remotely located, for storing data received from the monitoring device (or devices) 105. A user interface 173 allows operators or administrators to review the stored data or interactively adjust the operational parameters of the monitoring device (or devices) 105. In certain implementations, the remote monitoring station 170 may process incoming data from the monitoring devices 105 and relay the data, using any conventional means (such as electronic mail), to another site for storage or evaluation.

Figure 3:
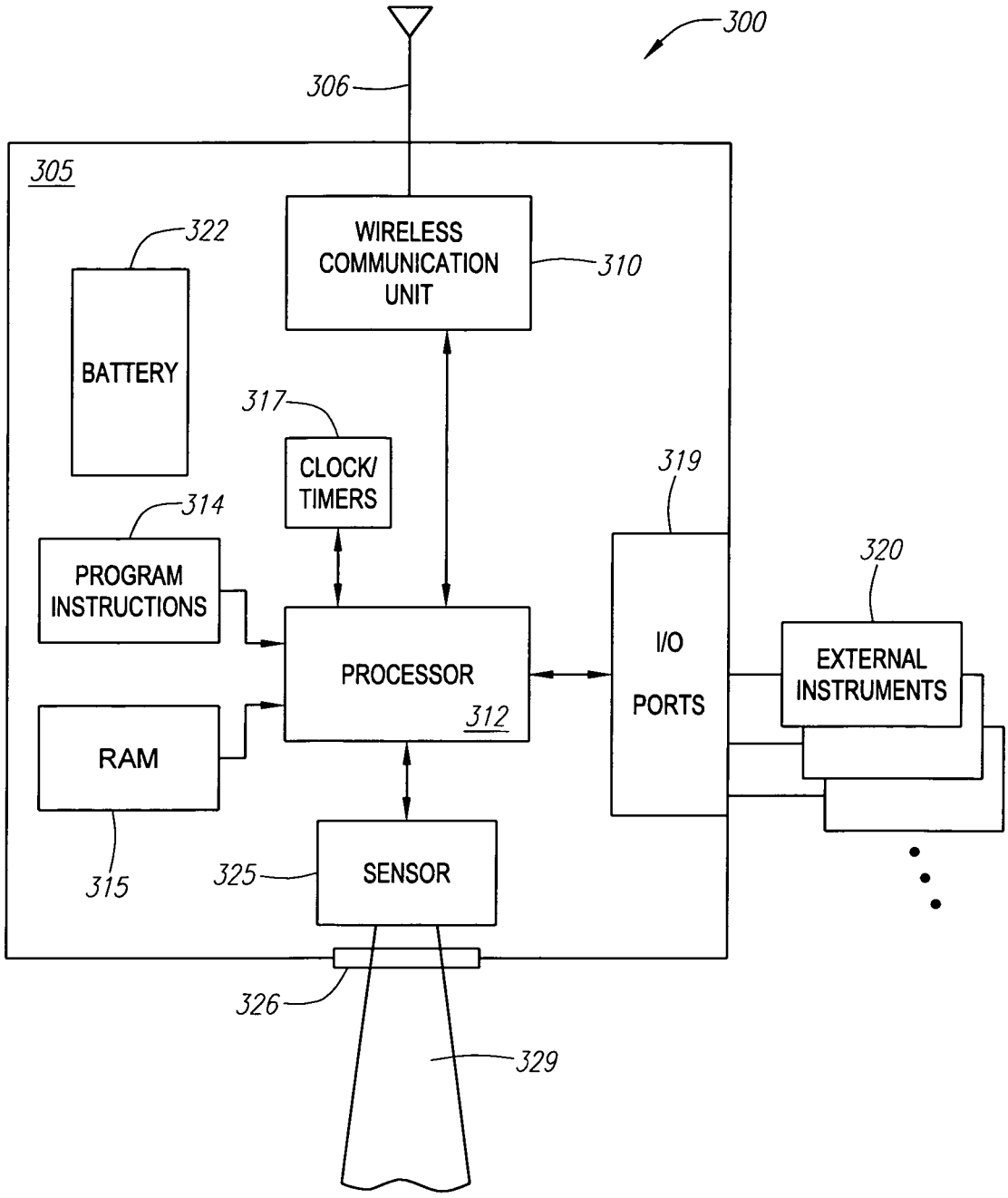
FIG. 3 is a block diagram of a preferred monitoring device.

Operation of the monitoring system 100 shown in FIG. 1 may be explained with reference to a preferred monitoring device 105, details of which, according to one example, are illustrated in FIG. 3. As shown in FIG. 3, a preferred monitoring device 300 includes housing 305 which is preferably formed of a water-resistant, non-corrosive lightweight material, such as plastic, fiberglass, or treated/sealed thin metal (e.g., aluminum). The housing 305 is preferably sealed so as to be effectively watertight, although a swinging panel or access door (not shown) may be provided to allow replacement of the batter 322 or possibly other components. The monitoring device 300 preferably comprises a wireless communication unit 310 which is attached to an antenna 306, for carrying out wireless communication with a wireless network (such as network 150 shown in FIG. 1). The wireless communication unit 310 preferably comprises at least a wireless transmitter but may also include a wireless receiver as well (or else be embodied as a wireless transceiver).

The monitoring device 300 preferably includes a processor 312 (which may comprise, e.g., a microprocessor, microcomputer, or digital circuitry) for controlling the basic functions of the monitoring device 300, including, for example, instructions to transmit data via the wireless communication unit 310, or interpretation of data received via the wireless communication unit 310. The processor 312 preferably includes (or is connected to) a non-volatile memory portion 314 for storing programming instructions for execution by the processor 312, and a volatile memory portion (e.g., random-access memory or RAM) 315 for storing programmable operation parameters, and for storing depth (e.g., water level) measurements as needed.

The processor 312 may be connected to various clocks and/or timers 317 for carrying out timing of certain events (e.g., timing of intervals between samples or data transmissions), and may be connected to a sensor 325 for measuring depth (e.g., water level). The sensor 325 is preferably capable of taking distance measurements in conditions of very low light as may be experienced when the device is installed in a manhole. The sensor 325 may, for example, be embodied as an ultrasonic sensor which uses the time delay of echoed sound waves to detect the distance from the sensor 325 to the nearest solid object (e.g., water surface). The sensor 325 may have a sensor window 326 affixed to the housing 305 of the monitoring device 300, for providing viewpath 329 for the sensor 325.

The monitoring device 300 preferably draws operating energy from an in-unit, low-voltage battery 322, which supplies energy to the processor 312, sensor 325, wireless communication unit 310, and any other components as necessary. As indicated elsewhere herein, the sensor sampling rate and data transmission rate of the monitoring device 300 are preferably kept to a minimum to prolong the life of the battery 322 as much as possible.

The monitoring device 300 may include one or more input/output (I/O) ports 319, to which can optionally be connected to various peripheral monitoring devices or instruments 320. Examples of peripheral monitoring devices include, for example, external flowmeters, heavy metal detectors, toxic gas detectors, and any other type of useful monitoring device. A peripheral monitoring device may also comprise a so-called "lab-on-a-chip," in other words, a microchip consisting of, e.g., interconnected fluid reservoirs and pathways that effectively duplicate the function of valves and pumps capable of performing manipulations such as reagent dispensing and mixing, incubation/reaction, sample partition, and analyte detection. The processor 312 may be configured to receive input signals, via the I/O ports 319, from the various peripheral monitoring devices 320, and to process the input signals, store the input signals in volatile memory 315, and/or convey the input signals, via the wireless communication unit 310, to the remote monitoring station. The monitoring device 300 may identify the various peripheral monitoring devices 320 by their particular I/O port number, by an equipment identification number or type number, or by any other suitable means, so that the remote monitoring station can interpret the source of readings or other information received from the monitoring device 300.

When not active, the various components of the monitoring device 300 are preferably rendered inactive by, e.g., placing them in a "sleep" state wherein no or minimal power is consumed. For example, the sensor 325, processor 312, and wireless communication unit 310, and possibly other components, may all be placed in an inactive state when no activity is necessary, and awakened upon the occurrence of an event needing attention (for example, the timeout of a sampling or reporting interval in a timer). At that point, power may be re-connected to the inactive components as necessary. Operation in this manner may significantly preserve battery life.

In operation, the monitoring device 300 takes periodic measurements of depth (e.g., water level) using the sensor 325, and stores the depth measurements in a volatile memory (e.g., RAM) 314. Preferably, the sample period of the sensor 325 is programmable or adjustable, so that the sample period can be varied according to circumstances. The stored depth measurements, or a subset of stored depth measurements, can be subsequently read out from the volatile memory 314 and transmitted, via the wireless communication unit 310, to the remote monitoring station 170. The monitoring device 300 can also periodically report its battery level to the remote monitoring station 170.

In a preferred embodiment, the time interval(s) between samples taken by the sensor 325 and the time interval(s) between data transmission from the monitoring device 300 to the remote monitoring station 170 are programmed through commands transmitted from the remote monitoring station 170 to the monitoring device 300. The time intervals are preferably stored, along with other operating parameters, in the volatile memory 315 of the monitoring device 300. Re-programming can be initiated in any of a variety of ways. For example, the remote monitoring station 170 may transmit a re-programming command to the monitoring device 300, followed by an identification of parameters to be altered, followed by the new parameter values. The particular format and protocol of the re-programming operation depends upon the communication technique employed. The remote monitoring station 170 may also re-program, through wireless commands transmitted to the monitoring device 170, parameters relating to any peripheral monitoring devices, such as the time interval(s) between transmitting data from the peripheral monitoring devices to the remote monitoring station 170. In one embodiment, the monitoring device 300 is configured to pass through re-programming instructions to a specified peripheral monitoring device that can itself be remotely re-programmed.

The monitoring device 300 may also be configured to automatically adjust the sample rate of water measurements obtained from the sensor 325 without intervention needed by the remote monitoring station 170. In this embodiment, the monitoring device 300 is programmed with a number of different alert levels, each of which corresponds to a specified (optionally programmable) sensor sample rate and/or data transmission rate. As an example, the monitoring device 300 could be configured with a normal operating mode, a low alert operating mode, and a high alert operating mode. The particular operating mode can be dictated by the detected water level. The monitoring device 300 may ordinarily operate in the normal operating mode, wherein it may sample the depth (e.g., water level) at a first rate (e.g., every 60 minutes). If the water level exceeds a low alert threshold, then the monitoring device 300 transitions to a low alert operating mode, and increases sampling frequency to a second rate (e.g., every 20 minutes). When entering the low alert operating mode, the monitoring device 300 may optionally transmit a message to that effect to the remote monitoring station 170. If the water level then rises to an extent that it exceeds a high alert threshold, the monitoring device 300 transitions to a high alert operating mode, and increases sampling frequency to a third rate (e.g., every 10 minutes). When entering the high alert operating mode, the monitoring device may optionally transmit a message to that effect to the remote monitoring station 170.

The low alert threshold and high alert threshold may be pre-programmed, or may be programmed or re-programmed after installation of the monitoring device 300. The low alert and high alert thresholds may be based in part on data collected during the initial period of installation of the monitoring device 300.

The frequency with which data is transmitted from the monitoring device 300 to the remote monitoring station 170 may also be varied depending upon the operating mode. For example, in the normal operating mode, the monitoring device 300 may be programmed or configured to transmit data at a first rate (e.g., once/week) to the remote operating station 170. In the low alert operating mode, the monitoring device 300 may be programmed to transmit data at a second rate (e.g., once/day). In the high alert operating mode, the monitoring device 300 may be programmed to transmit data at a third rate (e.g., once/hour).

The above sampling and broadcast rates are merely exemplary and are not intended to be limiting in any way. The actual sampling and broadcast rates may be selected based upon a number of factors, including the desired level of scrutiny for the particular manhole, the amount of available memory storage space to hold depth (e.g., water level) readings, and the need to preserve battery life to the maximum extent possible. Likewise, the monitoring device 300 may have more or fewer operating modes, depending upon the particular needs of the monitoring system 100.

In addition to automatic transitioning between operating modes, the monitoring device 300 may also be forced to transition between operating modes by commands received from the remote monitoring station 170, or may be programmed with override values for the sensor sampling interval and reporting interval (as well as the low and high alert threshold values). Alternatively, or in addition, the monitoring device 300, including its operating modes, can be programmable via one of the I/O ports 319. A benefit of remote programming of the sample and reporting intervals is that the monitoring device 300 may be manually set to more frequent sampling or reporting rates during certain times such as periods of bad weather (because of, e.g., possible rainwater infiltration) or local construction (which may cause obstructions, breaks, or leakages).

In a preferred embodiment, when reporting to the remote monitoring station 170 in the normal course of operation, the monitoring device 300 transmits a unique device identifier followed by the stored depth (e.g., water level) measurements. The monitoring device 300 may also record timestamp data relating to the depth measurements as the readings are taken, and transmit this information along with the stored depth measurements to the remote monitoring station 170. At the same time, or at other reporting intervals, the monitoring device 300 may also transmit data from any peripheral monitoring devices connected to it. When a water level reading exceeds an alert level (low or high), the monitoring device 300 preferably transmits immediately to the remote monitoring station 170 the device identifier, water measurement reading value, and an alarm code indicating the nature of the alert. At the same time, as noted above, the monitoring device 300 preferably enters an alert mode wherein it takes more frequent water level readings and/or reports to the remote monitoring station 170 more frequently.

The remote monitoring station 170 preferably processes the data received from all of the monitoring devices 105 and centrally manages the overall operation of the monitoring system 100. As previously indicated, the remote monitoring station 170 may transmit new operating parameters (including mode selections) to the various monitoring devices 105. The new operating parameters may, for example, by manually selected or entered by an administrator or operator via the user interface 173 at the remote monitoring station 170. Upon receiving an alert or alarm message from any of the monitoring devices 105, the processing system 172 may signal an operator or administrator by, e.g., activating a display light or audible alarm, and/or sending an electronic message (e.g., by e-mail or pager) or electronic facsimile communication to appropriate personnel. Historical data from the monitoring devices 105 may be stored in the database 174 and analyzed for whatever desired purpose—e.g., hazard evaluation, growth planning, etc. The database 174 may also correlate each device's unique identifier with its location, customer billing information (if applicable), and emergency handling procedure.

When an alert or alarm message is received by the remote monitoring station 170, the processing system 172 or a manual operator may attempt to confirm the existence of a hazardous situation, or evaluate a possible cause thereof, by comparing the water level readings of the monitoring device 105 sending the alert or alarm with the readings received from other monitoring devices 105 along the same pipeline (upstream or downstream). If those monitoring devices 105 are not yet at their typical reporting period, the remote monitoring station 170, automatically or under manual control, can issue commands to the other monitoring devices 105 to send their current water level readings to the remote monitoring station 170 for evaluation.

The remote monitoring station 170 may communicate with the various monitoring devices 105 according to any available and suitable wireless communication technique. Preferably, the wireless communication equipment on the monitoring device 105 and the wireless communication technique are selected so as to provide adequate penetration through the sewer manhole cover 103, to allow proper monitoring of and communication with the installed monitoring device 105. In a particular embodiment, the monitoring device 105 communicates with the remote monitoring station 10 using a suitable two-way pager communication protocol, such as, for example, the Wireless Communications Transport Protocol (WCTP), which offers mechanisms for passing alphanumeric and binary messages. Two-way pager communication may be carried out over the ReFLEX™ network, which provides widespread geographical coverage of the United States, or any other available network. Communicating through a two-way pager network may have the advantage of being less costly than, e.g., communicating over a wireless cellular network.

In alternative embodiments, the monitoring devices 105 may communicate with the remote monitoring station 170 through other types of wireless networks, such as a cellular, PCS, or GSM wireless network, or through any other type of wireless network. Communication may be conducted through base stations 152 (as illustrated in FIG. 1), and/or via communication satellites, and/or through wireless repeaters or relay stations. In remote locations, for example, where a monitoring device 105 may not be near a wireless base station 152, a wireless repeater (not shown) may be positioned above ground near the manhole 108, to provide an intermediary link between the monitoring device 105 and the wireless network 150.

In some embodiments, messages transmitted wirelessly between the monitoring device 105 and the remote monitoring station 170 are formatted or exchanged according to a standard Internet protocol, such as, for example, the Simple Mail Transport Protocol (SMTP) or HyperText Transfer Protocol (HTTP). Scaled-down versions of these protocols may be utilized where certain functionality is not necessary for the purposes of the monitoring system 100.

Figure 2:
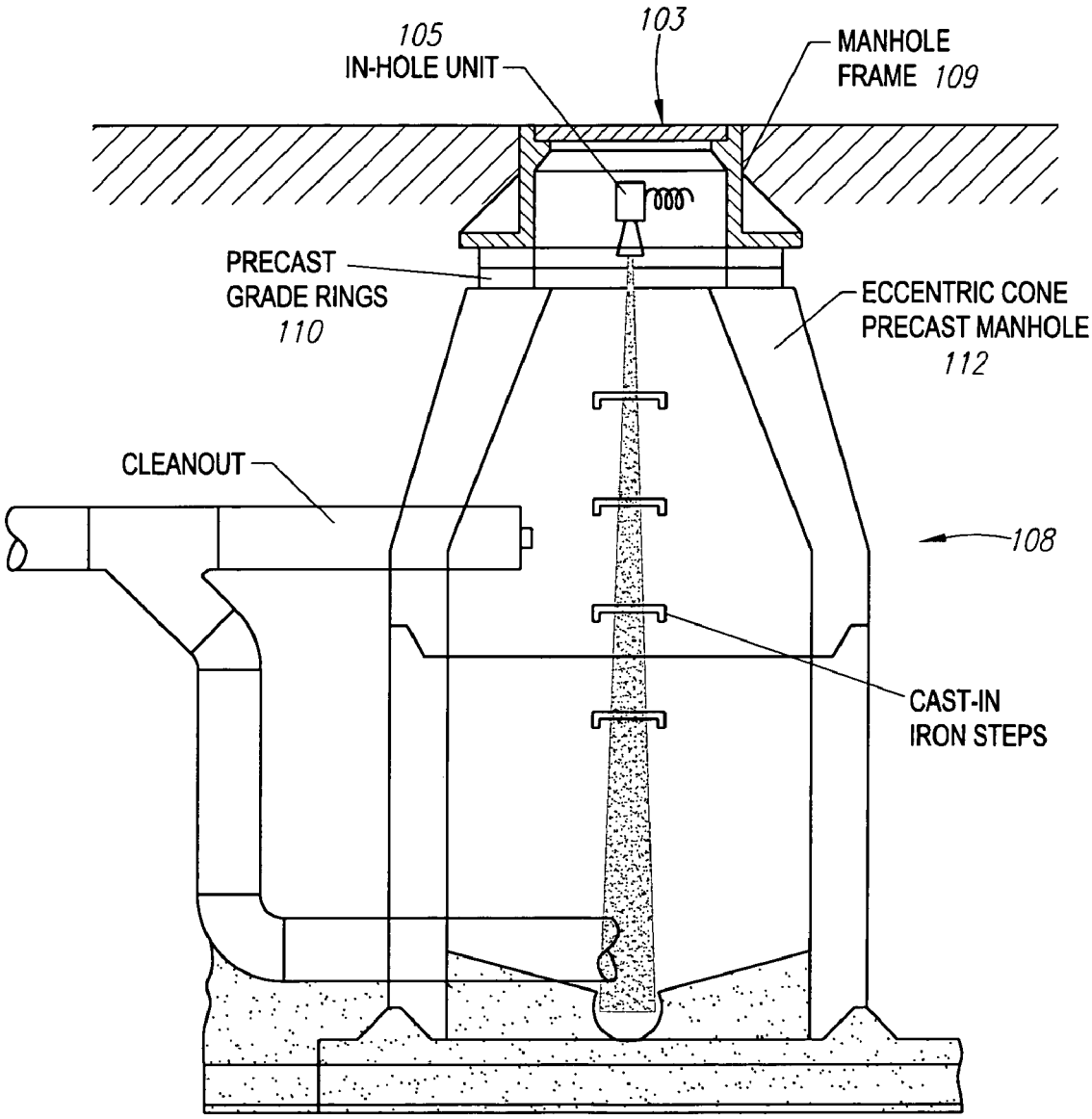
FIG. 2 is a diagram illustrating the positioning of a monitoring device in a manhole.

Various features of a preferred monitoring device relate to means for securing the monitoring device to the interior of a manhole cavity. FIG. 2, for example, illustrates in somewhat greater detail the positioning of a monitoring device 105 in a manhole 108. As shown in FIG. 2, a manhole 108 may have a manhole frame 109 abutting the ground surface, with a manhole cover 103 for providing access to the manhole cavity. The manhole 108 may include a pre-cast cone-shaped housing 112, typically formed of concrete or a similar durable and relatively inexpensive material. One or more precast rings 110 may be interposed between the manhole frame 109 and the cone-shaped manhole housing 112. Preferably, the monitoring device 105 is mounted near the top of the manhole 108, within the area of the manhole frame 109 (if provided).

Figure 4A:
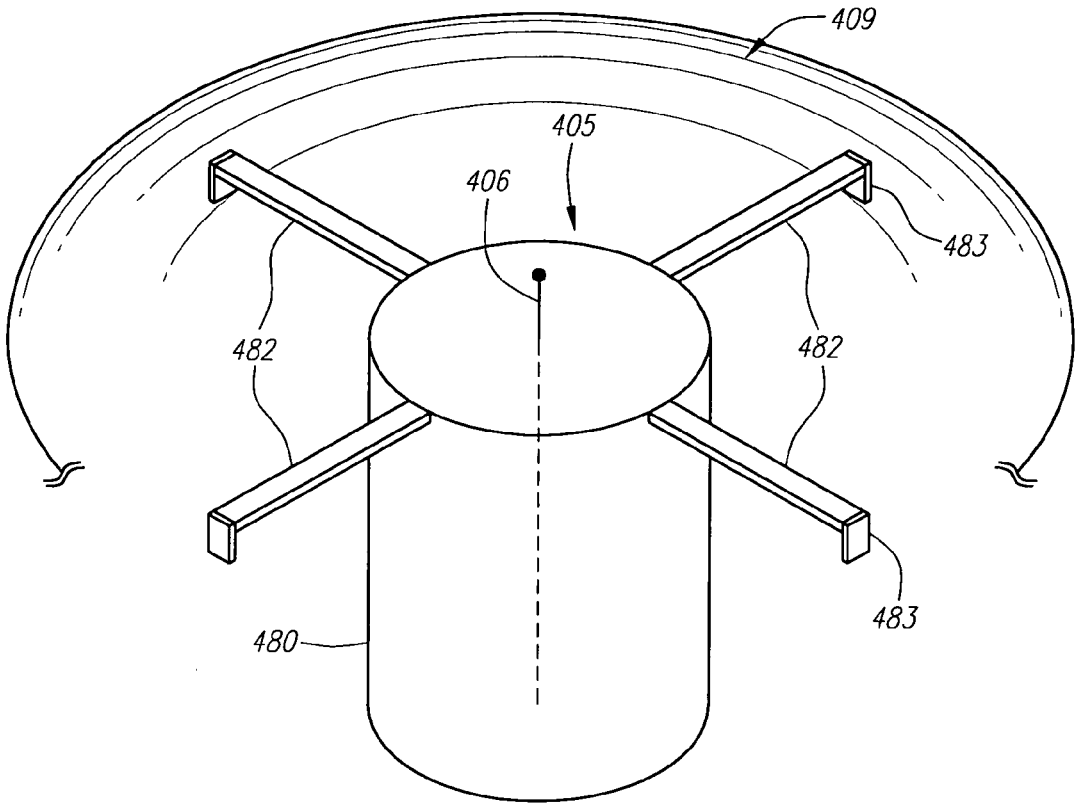
FIG. 4A is a diagram illustrating a monitoring device including legs for mounting within a manhole.
Figure 4B:
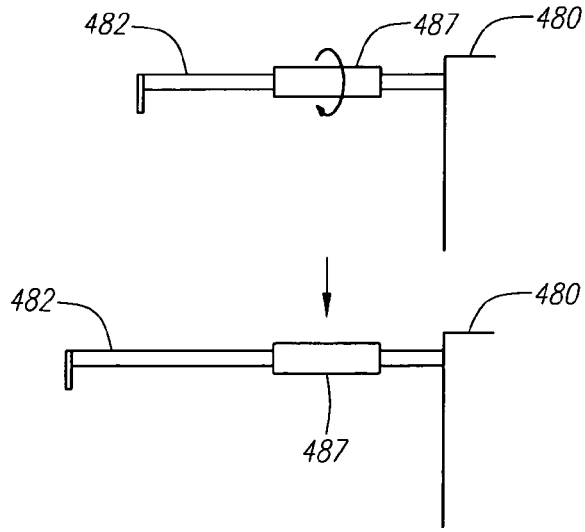
FIG. 4B is a diagram illustrating a rotatable member for adjusting the length of a leg for securing a monitoring device within a manhole cavity.

To facilitate rapid installation and removal of the monitoring device 105, the monitoring device 105 is preferably suspended in the manhole by multiple legs which emanate from the housing of the monitoring device 105. FIG. 4A is a diagram illustrating a monitoring device 405 including legs 482 for mounting within a manhole frame 409. The internal functional features of the monitoring device 405 shown in FIG. 4A may conform, for example, to those shown in FIG. 3 or FIG. 5. As illustrated in FIG. 4A, a set of legs 482 emanate from the housing 480 (depicted in a cylindrical shape) of the monitoring device 405, effectively suspending the monitoring device 405 at the top of the manhole cavity. The legs 482 may be formed, in whole or part, of a pliable, flexible or compressible material, to allow the legs to adapt to the particular width across the manhole frame 409 (or the top of the manhole cavity, if no manhole frame is present). Alternatively, the legs 482 may have a rotatable screw member 487 for allowing adjustment of leg length, as illustrated in FIG. 4B, or a telescoping leg member. The legs 482 may be terminated in feet 483 which are preferably surfaced with an adhesive or gripping material to allow the legs to firmly grasp the inner surface of the manhole frame 409.

The number of legs 482 used to secure the monitoring device 405 to the interior of the manhole may vary depending upon a number of factors. Generally, three or four legs 482 should be sufficient to secure the monitoring device 405. However, even a single leg can be used, if one side of the housing 480 is in contact with the interior surface of the manhole frame 409. In such an embodiment, the contacting side of the device housing 480 may be surfaced with a gripping material such as soft rubber or foam, for example. From a composition standpoint, it may be desirable to manufacture the legs 482 from a non-metallic material, to avoid possible interference with wireless transmission or reception by the monitoring device 405.

Installation of the monitoring device 405 shown in FIG. 4A may be conducted as follows. First, workers may remove or tilt open the manhole cover, and then lower the monitoring device 405 into the manhole cavity. The monitoring device 405 may be tethered when lowering and installing it (or removing it), to prevent it from dropping to the bottom of the manhole cavity should it slip. Since the total span of a pair of legs 482 may exceed the width of the manhole opening, the workers may need to bend or flex one or more legs 482, or, if having a rotatable screw or telescoping member, retract one or more legs 482 when passing the monitoring device 405 through the manhole opening. Once inside the manhole frame 409 (or top of the manhole cavity), the legs may be released or extended and pressed against the inner surface of the manhole frame 409. The gripping feet 483 at the end of the legs 482 are preferably used to secure the monitoring device 405 in position. As noted previously in connection with various other embodiments, the monitoring device 405 is preferably formed of a lightweight material and composed of lightweight components (e.g., low voltage battery, microcircuitry, etc.), and a benefit of such construction is that the device 405 can be more easily suspended with a mounting structure such as illustrated in FIG. 4A. To remove the monitoring device 405, the legs 482 are simply bent, flexed, or retracted, and the device 405 pulled up through the open manhole cover.

While no clamps or screws are necessary to secure the monitoring device 405 in the above example, in alternative embodiments, screws, clamps, mounting brackets, or other means for securing the monitoring device 405 may be utilized.

An advantage of various mounting structures and techniques described above is that the monitoring device 405 may be relatively simple and easy to install or remove, even by unskilled workers, and generally does not require the use of tools nor the need to drill into the wall of the manhole. Also, the monitoring device 405 can be installed without necessarily requiring workers to bodily enter the manhole enclosure, which can be advantageous in certain settings. For example, when a worker bodily enters a manhole enclosure, government regulations may impose special requirements, such as additional workers outside the manhole, the use of safety harness, an air supply, and so on, all of which increases cost and time of installation or removal.

In the example shown in FIG. 4A, the monitoring device 405 has a whip antenna 406 that is partially located within the housing 480 and partially extends atop the housing 480. The antenna 406 is preferably directional in nature, so as to maximize penetration through the manhole cover. However, other antenna configurations may also be employed. For example, a small diameter hole may be drilled through the manhole cover, and an antenna extension placed through the small hole to provide better wireless access. The tip of the antenna may be coated, glazed or sealed so that it lies flush with the surface of the manhole cover and is relatively secure thereon. The antenna extension may be connected via a cable or other means to the main housing 480 of the monitoring device 405. In another embodiment, an antenna may be placed on the surface of the manhole, and magnetic coupling used to transmit signals from inside the manhole through the externally located antenna. Other alternative antenna arrangements may also be used.

Figure 6A:
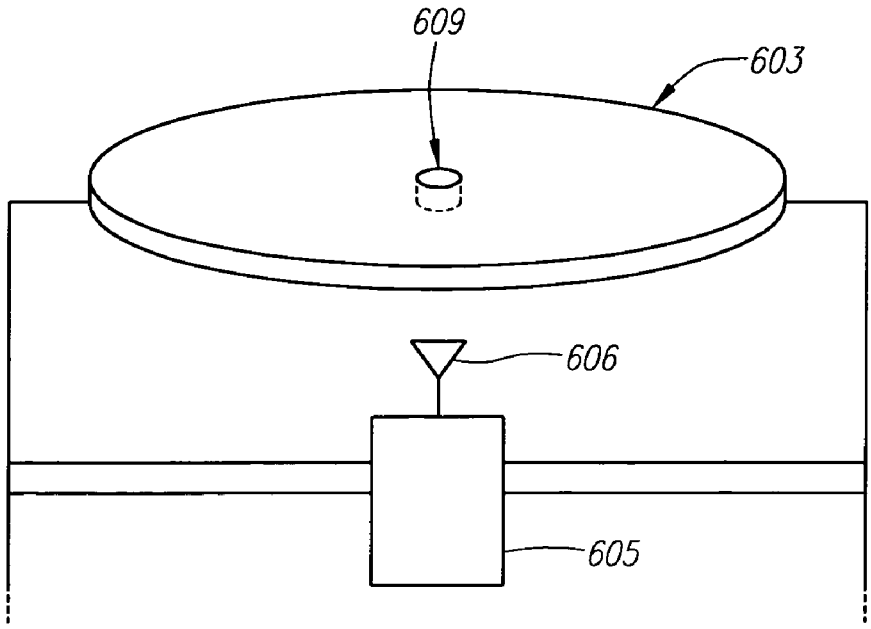
FIGS. 6A and 6B are diagrams illustrating an example of one type of antenna configuration for a monitoring device.
Figure 6B:
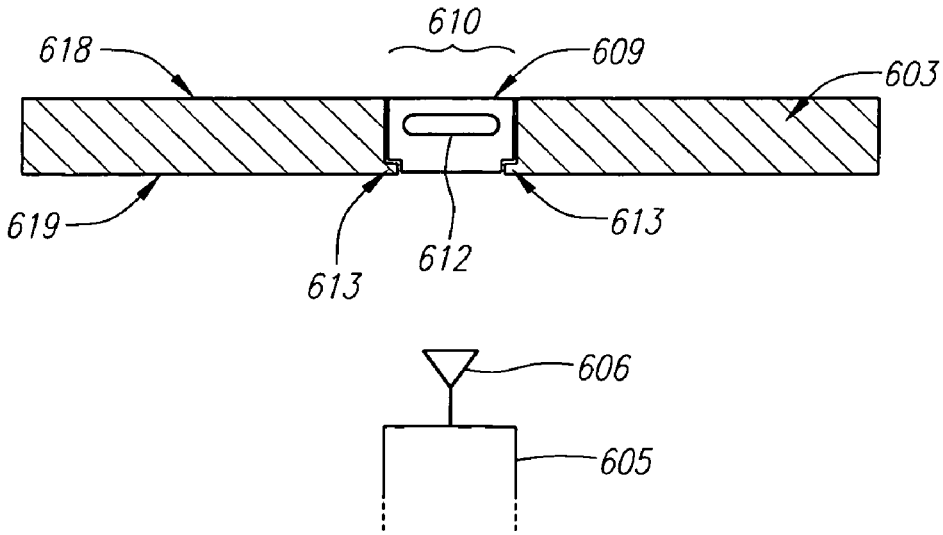

FIGS. 6A and 6B are diagrams illustrating an example of one such alternative antenna configuration. FIG. 6A shows an oblique view of a monitoring device 605 with an antenna piece 609 inserted into a hole in the manhole cover 603, while FIG. 6B shows a cross-sectional view of the antenna piece 609 inserted in the hole 610 in the manhole cover 603. The hole 610 may, for example, be counter-bored into the manhole cover 603 to provide a suitable resting location for the antenna piece 609. The antenna piece 609 may be of any size required to fit a suitable antenna array 612 (for example, it may be approximately two inches across), and may be any shape, although circular is preferred because of the ability to fit it within a circular hole that can be readily created from drilling into the manhole cover 603. Alternative shapes include, for example, a cone or funnel shape, or even a rectangular or polygonal shape where, for example, the manhole cover 603 has a pre-cast hole 610 that does not require drilling in the field. The hole 610 may be created from two drilling steps, a first step to bore a wide cylindrical insert, and a second step to bore a narrower hole through the base of the cylindrical insert, thus forming a lower lip 613 on which the antenna piece 609 can rest. Alternatively, a combined counter-bore drill bit may be used to drill the hole 610 in a single step. Preferably, the hole 610 is of a width such that the antenna piece 609 fits snugly therein, and the antenna piece 609 can be secured by screws, epoxy, or other means once inserted in the hole 610.

The antenna piece 609 is preferably manufactured of durable, resilient material such as plastic, that nevertheless allows for propagation of wireless signals both upwards, outside of the manhole 608, and downwards towards the monitoring device 605. Any of a variety of conventional wireless repeater antennas may be used or adapted for the antenna array 612 of the antenna piece 609; examples of conventional wireless repeater antennas which propagate signals through glass or other dielectrics are known, for example, in the automotive industry. The monitoring device 605 preferably includes a separate antenna 606 which wirelessly couples to the antenna array 612 within the antenna piece 609, to allow wireless communication between the monitoring device 605 and a wireless base station or network. The antenna piece 609 is preferably flush with the top surface 618 of the manhole cover 603 to prevent it from interfering with surface activity (for example, snow plow blades), but nevertheless should have a clear "horizon" view for optimal wireless reception and transmission. Likewise, the antenna piece 609 is preferably shaped such that it does not protrude from the bottom surface 619 of the manhole cover 603, so that the manhole cover 603 can be easily dragged along the ground without causing harm to the antenna piece 609. The antenna array 612 may constitute, for example, a directional-type antenna, so that loss of energy is minimized.

In certain embodiments, in order to provide as close proximity as possible between coupled antenna elements, the antenna 606 connected to the monitoring device 605 is formed as or contained within a springy wire loop that touches or nearly touches the underside of the antenna piece 609. The flexibility of the antenna 606 in such an embodiment can help prevent damage when the manhole cover 603 is removed (since the manhole cover 603 is heavy, it may be swept across the manhole opening just above the monitoring device 605).

Figure 7:
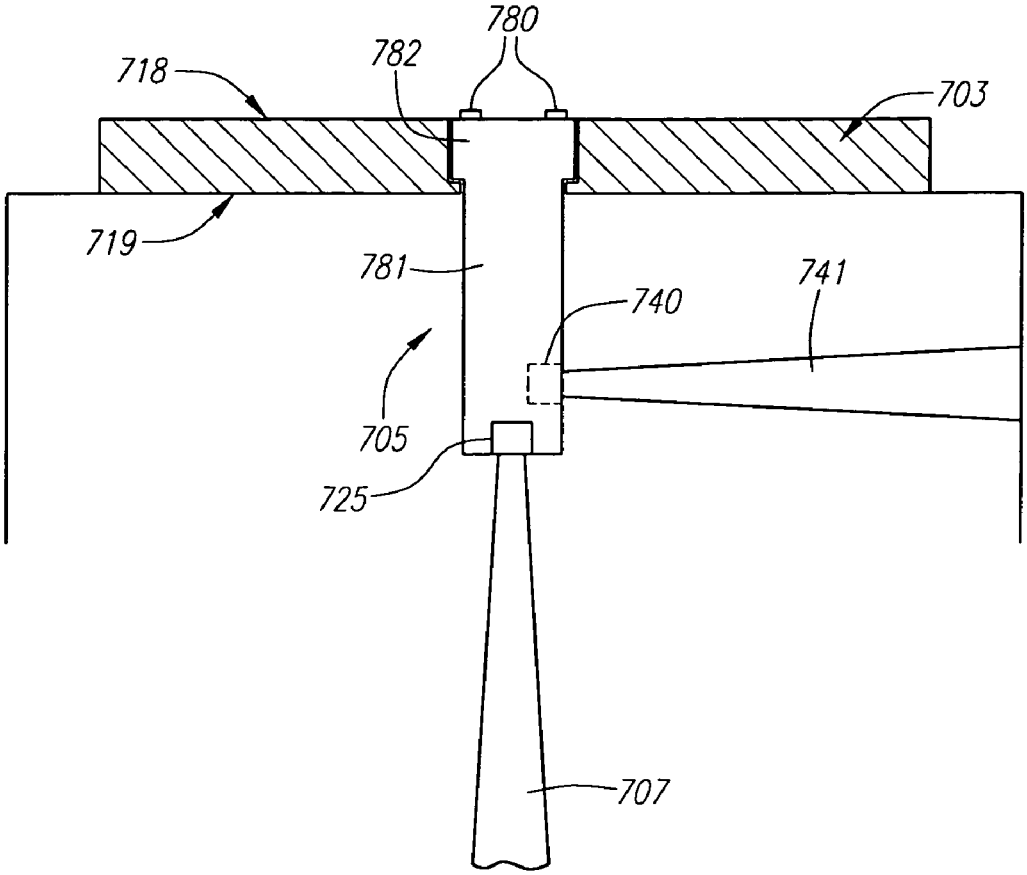
FIG. 7 is a diagram illustrating a monitoring device adapted for drop-down insertion into a manhole.
Figure 8:
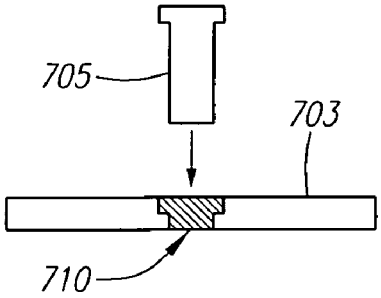
FIG. 8 is a diagram illustrating an example of insertion of the monitoring device of FIG. 7 into a manhole.

FIG. 7 is a diagram illustrating another embodiment of a monitoring device 705 that may be of particular utility in situations where obtaining a sufficiently clear signal path to a wireless network is otherwise difficult. The monitoring device 705 preferably has a cylindrical body 781 terminated in a slightly wider cylindrical cap 782, to allow the monitoring device 705 to be securely inserted, in a drop-down fashion, into a counter-bored hole (similar to that described with respect to FIG. 6B) in a manhole cover 703. FIG. 8 illustrates how the monitoring device 705 may be inserted into a counter-bored hole 710 the manhole cover 703.

The monitoring device 705 preferably includes, encapsulated within the body 781 and/or cap 782, the various internal components illustrated for the monitoring device 300 in FIG. 3. However, the monitoring device 705 may include additional or fewer components. The depth sensor 725 may be positioned at the base of the body 781 to allow an unobstructed view of the floor of the manhole cavity. As is described in greater detail below with respect to FIG. 5, a second sensor 740 may optionally be positioned on the side of the housing 781 of the monitoring device 705, to detect if the manhole cover 703 (and thus the monitoring device 705) has been removed or otherwise moved from its ordinary resting position. The second sensor 740 may alternatively be a pressure-type sensor that is placed between the manhole cover 703 and the perimeter of the manhole opening, to detect if the manhole cover 703 is moved from its ordinary resting position. An antenna (not explicitly shown in FIG. 7) may be located in the cap 782 of the monitoring device 705, to provide an optimum wireless signal path to remote wireless transmitters and/or receivers. The antenna may be any compact type antenna having electrical characteristics suitable for communication in the intended location/placement of the monitoring device 705. In certain embodiments, the antenna may be embedded in plastic to isolate it from the metal of the manhole cover 703. Since the monitoring device 705 has surface accessibility, it may optionally be outfitted with, e.g., solar cells 780 to allow re-charging of the battery during daylight operation.

An advantage of the configuration of the monitoring device 705 in FIG. 7 is that it can be placed in a manhole cover 703 without the need to remove the manhole cover 703 (which can be a somewhat difficult task since manhole covers are fairly heavy and may be hard to dislodge due to, e.g., accumulation of sediments, etc.). To facilitate placement of the monitoring device 703, a counter-bore hole can be drilled into the manhole cover 703, and the monitoring device 705 dropped into the counter-bored hole and secured. The monitoring device 705 can be secured to the manhole cover 703 in any of a variety of ways. For example, it may be bolted to the manhole cover 703 or otherwise locked into place.

Figure 9:
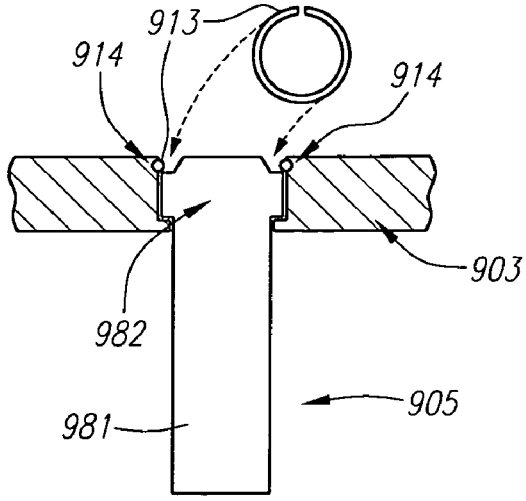
FIG. 9 is a diagram illustrating an example of a drop-down monitoring device secured to a manhole lid by a retaining ring.

In one embodiment, illustrated in FIG. 9, the monitoring device 905 is secured in place by a retaining ring 913. The retaining ring 913 may be compressed prior to being inserted into the hole just above the cap 982 of the monitoring device, and then released so that it snaps out and conforms to the shape of a circular groove 914 surrounding the cap 982 of the monitoring device 905. The spring-like action of the retaining ring 913 serves to keep it locked in place. Retaining ring pliers may be used to facilitate removal of the retaining ring 913 and thus removal of the inserted monitoring device 905. In this particular embodiment, the cap 982 may be raised in the center to provide a flush surface with the top surface 918 of the manhole cover 903.

The actual shape and dimensions of the monitoring device 705 may vary depending upon a number of factors. For example, it may, in certain situations (especially, e.g., where peripheral monitoring devices are not going to be used), be possible to fit all necessary electronics (including a battery/power supply) and sensor components in a housing roughly the size of the antenna piece 609 shown in FIG. 6, in which case the monitoring device 705 may be approximately the size and shape of the upper cap 782 shown in FIG. 7. As another example, the upper cap 782 and/or body 781 of the monitoring device 705 may be non-cylindrical in shape. As but one illustration, the manhole cover 703 may be cast with a pre-fabricated square hole (with a protruding lower lip) into which a square-shaped monitoring device 705 may be inserted. As another illustration, the upper cap 782 may be tapered (conical) or funnel-shaped, and the hole may be of matching shape (either drilled on site or pre-molded in the manhole cover 703). Of course, other shapes and sizes may be utilized. A cylindrical shaped monitoring device 705 is preferred in those applications where pre-existing manholes may require drilling in order to retrofit with the monitoring device 705.

Figure 5:
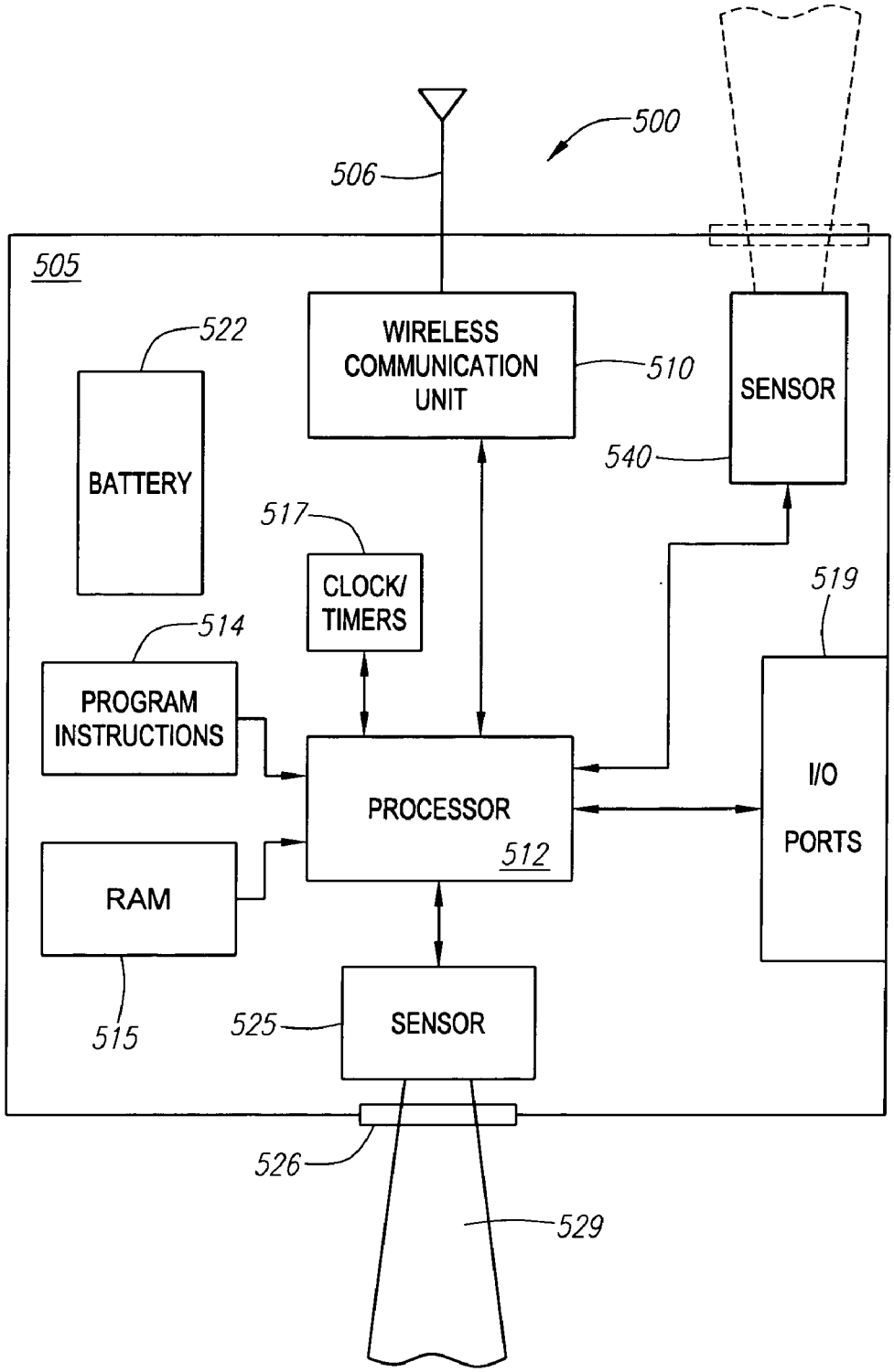
FIG. 5 is a block diagram illustrating an alternative embodiment of a monitoring device.

FIG. 5 is a block diagram illustrating an alternative embodiment of a monitoring device 500, as may be employed, for example, in the monitoring system 100 shown in FIG. 1, or other such systems. Among other things, the monitoring device 500 shown in FIG. 5 provides some degree tamper resistance with respect to the manhole 108 in which it is installed. In the example of FIG. 5, elements labeled with reference numerals "5xx" are generally similar to their counterparts labeled with "3xx" in FIG. 3. However, the monitoring device 500 in FIG. 5 includes some additional features. The monitoring device 500 in FIG. 5 comprises, in addition to a first sensor 525 for taking depth measurements, a second sensor 540 for detecting whether the manhole cover 103 has been tampered with. The second sensor 540 may be embodied, for example, as a pressure sensor, with a pressure plate to be positioned such that if the manhole cover 103 is raised, the reduction in pressure will be detected. Alternatively, the second sensor 540 may be embodied as an optical (e.g., infrared) or ultrasonic detector, oriented upwards towards the manhole cover 103. The second sensor 540 may be initialized or calibrated to the distance of the manhole cover 103. If the manhole cover 103 is raised or removed, the second sensor 540 detects the change and registers an alert or alarm condition. In such a case, the monitoring device 500 is preferably configured to transmit an alarm signal indicating tampering to the remote monitoring station 170 to place the appropriate personnel on notice.

If the second sensor 540 is required to sample periodically, the interval between sample periods is preferably programmable or otherwise selectable. The time between samples may, for example, be programmable via wireless commands received from the remote monitoring station 170. The second sensor 540 might be commanded to sample more frequently prior to or during important events in the local area, such as a parade, etc., where it may be considered important to ensure that manholes are not removed or otherwise tampered with. Likewise, the monitoring device 500 may be programmed to report back more frequently to the remote monitoring station 170 during such events. The failure to receive an expected reporting transmission at the remote monitoring station 170 at a particular time may result in an alarm or alert signal being generating at the remote monitoring station 170, indicating the monitoring device 500 may have malfunctioned or else been tampered with. In the absence of extraordinary events, the sampling period may be selected so as to provide the desired level of security while at the same time maximizing battery life.

In certain embodiments, the remote monitoring station 170 may, pursuant to programmed instructions or manual commands entered via the user interface 173, transmit a status request signal to the monitoring device 500, requesting verification that the manhole cover is in place. Upon receiving such a status request signal, the monitoring device 500 activates the second sensor 540, obtains a reading, and transmits the information back to the remote monitoring station 170. This operation allows greater flexibility in verifying the proper placement of manhole covers without necessarily having to increase the sampling/reporting rates of the second sensor 540 significantly, and can advantageously be used for test and verification purposes as well.

Alternatively, or in addition, a photocell sensor can be used in the monitoring device 500, to detect the presence of light entering the manhole (thereby indicating that the manhole cover has been removed or that a source of light, such as a flashlight or lantern, is nearby).

In any of the various embodiments, a monitoring device may be outfitted with a digital camera or other imaging device, and/or a microphone, for collecting visual images and/or audio data which can be stored or transmitted directly to the remote monitoring station. The visual or audio data may be used to verify an alert condition, allow engineers or field workers to make remote observations, or provide an additional level of security. The digital camera or imaging device, and/or microphone, may be integrated as part of the monitoring device, or else may be an external component connected to one of the monitoring device's input/output ports. The digital camera or imaging device may be oriented, for example, downwards to provide observation of the base of the manhole or other location, or upwards to provide observations of the manhole cover or other features. A mirror (possibly movable) may be used to allow a single digital camera or imaging device to view more than one area. The digital camera or imaging device, and/or microphone, may be remotely controlled through the remote monitoring station 170, and/or may be programmed to take periodic snapshots of visual or audio data according to a selectable time schedule.

In any of the monitoring systems described herein, a particular type of monitoring device may be used exclusively, or else a combination of different monitoring devices may be used. For example, an in-hole monitoring device (such as illustrated, e.g., in FIG. 6A) may be used in locations where a sufficiently clear communication channel is available, and a surface-accessible monitoring device (such as illustrated, e.g., in FIG. 7) may be used in locations where it is difficult to obtain a sufficiently clear communication channel using an in-hole monitoring device. Similarly, monitoring devices connected to the monitoring station by landlines may be used in combination with wireless monitoring devices, in connection with an integrated monitoring system having both wired and wireless monitoring devices.

With any of the monitoring devices described herein, a selection of different types of wireless communication may be provided. According to one technique, for example, the specific wireless circuitry is selected at the time of installation. Field workers may test a number of different types of wireless equipment at an installation site, and select the one with optimal reception (e.g., signal strength). The monitoring device may be configured such that a small module (e.g., circuit board, electronic chip, or other type of module) containing the appropriate wireless circuitry may be inserted into the monitoring device prior to installation. Different monitoring devices may therefore utilize different types of wireless communications, and different wireless providers, to communicate with the remote monitoring station. According to an alternative technique, several different types of wireless circuitry are included in the same monitoring device, and a switch provided on the monitoring device is used to select which type of wireless circuitry to utilize.

While various components are described in certain embodiments as being "connected" to one another, it should be understood that such language encompasses any type of communication or transference of data, whether or not the components are actually physically connected to one another, or else whether intervening elements are present. It will be understood that various additional circuit or system components may be added without departing from teachings provided herein.

Implementation of one or more embodiments as disclosed herein may lead to various benefits and advantages. For example, a monitoring system in accordance with certain embodiments as disclosed herein may provide sanitary wastewater system owners and/or operators with an early warning of possible overflow conditions at specifically monitored manhole or other locations, thus allowing the owner/operators sufficient time to prevent actual overflow by cleaning, servicing, shutoff, or other measures. Overflow prevention reduces the risk of costly cleanup operations, health hazards and environmental damage, interruption in service, and penalties from regulatory authorities or agencies. Other potential benefits of various monitoring systems as disclosed herein include reduction of routine preventative pipe cleaning and its associated costs, sewer system historical data for growth planning, and gross rainwater infiltration measurements.

While various systems and devices disclosed herein have most often been described in the particular context of monitoring, it will be understood that the techniques and principles disclosed may be applicable or adapted to other situations wherein it may be necessary or desirable to monitor the level of water, liquid, or any other time of substance that can accumulate over time. For example, monitoring systems as disclosed herein may be applicable to measuring and monitoring any type of water body (such as rivers, lakes, or coastal waters), or any type of liquid in an open pipe setting, or any other type of measurable matter (e.g., sand, ore, silt, mud, etc.) that accumulates.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. An integrated monitoring apparatus for monitoring the liquids, sediments or material accumulated within a sewer manhole, comprising:

a housing adapted to be secured to or integrated with a lid of a sewer manhole;

an ultrasonic or distance sensor unit located within said housing or integrated therewith, said sensor unit configured to obtain depth measurements at periodic intervals;

a wireless transceiver located within said housing; and a processor located within said housing, said processor connected to said wireless transceiver and configured to periodically transmit the depth measurements to a remote monitoring station.

2. The monitoring apparatus of claim 1, further comprising a plurality of legs attached to said housing, said legs adapted to secure said housing to an interior surface of the manhole;

wherein at least one of said legs is adjustable in length to facilitate securing the monitoring apparatus to said interior surface of the manhole by spanning an opening of the manhole and securably contacting opposing sides of said opening.

3. The monitoring apparatus of claim 1, further comprising a sensor window affixed to said housing, said sensor window providing a viewpath for said ultrasonic or distance sensor unit to obtain said death measurements.

4. The monitoring apparatus of claim 1, wherein said wireless transceiver communicates with the remote monitoring station over a public telephone network using a two-way pager communication technique.

5. The monitoring apparatus of claim 1, wherein said wireless transceiver communicates with the remote monitoring station in a format compatible with a standard Internet protocol.

6. The monitoring apparatus of claim 1, wherein said transceiver comprises an integrated or freestanding antenna.

7. The monitoring apparatus of claim 1, further comprising a memory located within said housing for storing the depth measurements from said sensor, and wherein said processor is configured to periodically transmit the stored depth measurements, via said wireless transceiver, to said remote monitoring station.

8. The monitoring apparatus of claim 1, further comprising one or more input/output ports configured to receive input signals from peripheral monitoring devices, wherein said processor is configured to convey said input signals, via said wireless transceiver, to the remote monitoring station.

9. The monitoring apparatus of claim 8, wherein said peripheral monitoring devices include a flowmeter.

10. The monitoring apparatus of claim 8, wherein said peripheral monitoring devices include either a heavy metal detector or a toxic gas detector, or both.

11. The monitoring apparatus of claim 8, wherein said peripheral monitoring devices include a lab-on-a-chip.

12. The monitoring apparatus of claim 8, wherein said processor is programmable via one or more of said input/output ports.

13. The monitoring apparatus of claim 1, wherein said processor is programmable through remote instructions received from the remote monitoring station via said wireless transceiver.

14. The monitoring apparatus of claim 13, wherein said remote instructions are operable to alter a time interval between transmitted depth measurements from said monitoring apparatus.

15. The monitoring apparatus of claim 14, wherein said remote instructions are operable to alter a sampling time interval between the depth measurements.

16. The monitoring apparatus of claim 1, further comprising a second sensor unit integrated within said housing, said second sensor unit configured to detect, at a distance, movement of the manhole lid positioned above the monitoring apparatus.

17. The monitoring apparatus of claim 16, wherein said second sensor unit comprises an optical or sonic presence detector oriented in an upwards direction towards the manhole lid when the apparatus is installed within the manhole.

18. The monitoring apparatus of claim 16, wherein said processor is configured to transmit a warning signal via said wireless transceiver to the remote monitoring system when said second sensor unit detects that the manhole cover has been moved from its normal stationary position.

19. The monitoring apparatus of claim 1, wherein said housing is substantially formed of a water resistant, non-corrosive material.

20. A monitoring system for monitoring the liquids, sediments or material accumulated within a plurality of geographically dispersed sewer manholes, the system comprising:

a plurality of battery-operated, wireless monitoring devices positioned within sewer manhole cavities and configured to be attachable to or integrated with a lid of the sewer manhole thereof, for measuring depth in the manhole cavities, each of said monitoring devices using an ultrasonic or distance sensor for measuring depth; and a remote monitoring station configured to communicate with said monitoring devices through one or more intermediary wireless links located remotely from said remote monitoring station and within a geographical vicinity of the sewer manholes being monitored, said remote monitoring station receiving depth measurements at periodic intervals from said monitoring devices and durably storing said depth measurements.

21. The monitoring system of claim 20, wherein said monitoring devices measure depth at a programmed sample interval, and transmit the depth measurements at a programmed transmission interval, longer than said sample interval.

22. The monitoring system of claim 21, wherein said monitoring devices are configured to compare depth measurements with a programmed alarm value and, if said alarm value is exceeded, to send a warning signal to the remote monitoring station.

23. The monitoring system of claim 20, wherein said monitoring devices are assigned unique digital identification numbers for distinguishing transmissions between the monitoring devices and the remote monitoring station.

24. The monitoring system of claim 20, wherein said monitoring devices communicate with the remote monitoring station over a public telephone network using a two-way pager communication technique.

25. The monitoring system of claim 20, wherein one or more of said monitoring devices is coupled to a flowmeter and transmits data from the flowmeter to the remote monitoring station at periodic intervals.

26. The monitoring system of claim 20, wherein one or more of said monitoring devices comprises either or both of a heavy metal detector and a toxic gas detector and transmits data therefrom to the remote monitoring station at periodic intervals.

27. The monitoring system of claim 20, wherein one or more of said monitoring devices comprises a lab-on-a-chip and transmits data therefrom to the remote monitoring station at periodic intervals.

28. The monitoring system of claim 20, wherein said monitoring devices are programmable through instructions received wirelessly from the remote monitoring station.

29. The monitoring system of claim 20, wherein one or more of said monitoring devices are configured with a second distance sensor to detect if a manhole lid positioned above the monitoring device is moved from its normal stationary position, and are further configured to transmit a warning signal to the remote monitoring station when detecting that the manhole lid has been moved.

30. A method of monitoring the liquids, sediments or material accumulated within a sewer manhole, the method comprising:

placing a monitoring apparatus within a sewer manhole by lowering the monitoring apparatus into a sewer manhole cavity and securing the monitoring apparatus to or integrated it with a lid of the sewer manhole, said monitoring apparatus comprising an ultrasonic or distance sensor oriented in a downward direction when installed within the manhole;

obtaining depth measurements of liquids, sediments or material accumulated at the bottom of the sewer manhole cavity at a sampling interval, using said sensor, and storing said depth measurements; and wirelessly transmitting, at a transmission interval longer than said sampling interval, one or more of the accumulated depth measurements to a remote monitoring station for processing;

wherein said step of wirelessly transmitting one or more of the accumulated depth measurements to the remote monitoring station comprises the step of communicating between the monitoring apparatus and the remote monitoring station over a path including a public telephone network, and using a format compatible with a standard Internet protocol.

31. The method of claim 30, further comprising the step of re-programming the monitoring apparatus through commands received wirelessly from the remote monitoring station, via a path including said public telephone network.

32. The method of claim 31, wherein said commands alter one or both of a time interval between transmitted depth measurements from said monitoring apparatus, and a sampling time interval between the depth measurements.

33. The method of claim 30, further comprising the step of using a second sensor unit to detect if a manhole lid located above the monitoring apparatus is moved from its normal stationary position, said second sensor unit comprising a distance sensor integrated in a housing with the first ultrasonic or distance sensor, and configured to be oriented upwards when the apparatus is installed beneath the manhole lid.

34. The method of claim 33, further comprising the step of transmitting a warning signal from the monitoring apparatus to the remote monitoring system when said second sensor unit detects that the manhole lid has been moved from its normal stationary position.

35. A method for monitoring the liquids, sediments or material accumulated within a sewer manhole, the method comprising:

boring a hole in a lid of a sewer manhole;

removing an additional portion of the lid so as to form a lip adjacent to the hole;

dropping a monitoring apparatus into the hole of the lid so that an outer portion of the monitoring apparatus rests on the lip and a top surface of said monitoring apparatus is substantially flush with a top surface of the lid, said monitoring apparatus including an ultrasonic or distance sensor oriented in a downward direction when thus positioned in the manhole lid;

obtaining depth measurements of liquids, sediments or material accumulated at the bottom of the sewer manhole cavity using said sensor; and wirelessly transmitting the depth measurements to a remote monitoring station for processing.

36. The method of claim 35, wherein said monitoring apparatus comprises an antenna disposed at or near the top surface thereof, and wherein the step of wirelessly transmitting the depth measurements to the remote monitoring station comprises the step of communicating between the monitoring apparatus and the remote monitoring station over a path including a public telephone network, using a format compatible with a standard Internet protocol.

* * * * *